US006301996B1

(12) United States Patent
Crawford

(10) Patent No.: US 6,301,996 B1
(45) Date of Patent: Oct. 16, 2001

(54) NAIL-STARTING HAMMER HEAD

(76) Inventor: Dennis Ellsworth Crawford, P.O. Box 645, Ridgeley, WV (US) 26753

( * ) Notice: Subject to any disclaimer, the term of this patent is extended or adjusted under 35 U.S.C. 154(b) by 0 days.

(21) Appl. No.: 09/661,095

(22) Filed: Sep. 13, 2000

Related U.S. Application Data

(63) Continuation-in-part of application No. 09/288,129, filed on Apr. 8, 1999, now abandoned.

(51) Int. Cl.[7] ..... B25D 1/00
(52) U.S. Cl. ..... 81/24; 81/23
(58) Field of Search ..... 81/20, 23, 24

(56) References Cited

U.S. PATENT DOCUMENTS

| | | | | |
|---|---|---|---|---|
| 115,008 | | 5/1871 | Young . | |
| 857,104 | * | 6/1907 | Parker, Jr. | 81/23 |
| 903,095 | | 11/1908 | Johnson . | |
| 937,987 | | 10/1909 | Carlson . | |
| 1,133,277 | | 3/1915 | Gore . | |
| 1,477,833 | | 12/1923 | Leak . | |
| 1,922,890 | | 8/1933 | Gevert . | |
| 2,597,876 | | 5/1952 | Kurkjian . | |
| 3,788,373 | | 1/1974 | Aherin . | |
| 3,987,828 | | 10/1976 | Mathesis . | |
| 4,193,433 | | 3/1980 | Sickler . | |
| 4,273,172 | | 6/1981 | Hoosier . | |
| 4,367,778 | | 1/1983 | Bradbury . | |
| 4,448,230 | | 5/1984 | Reed . | |
| 4,465,115 | | 8/1984 | Palomera . | |
| 5,988,020 | | 11/1999 | Johnson . | |

FOREIGN PATENT DOCUMENTS

| | | |
|---|---|---|
| 166552 | 3/1934 | (CH) . |
| 53378 | 3/1923 | (SE) . |

* cited by examiner

*Primary Examiner*—James G. Smith
*Assistant Examiner*—Joni B. Danganan
(74) *Attorney, Agent, or Firm*—Law Offices of Royal W. Craig

(57) ABSTRACT

An improved hammer head structure with integral nail-starting feature. The nail-starting feature is accomplished by a nail head seat horizontally forged, bored or otherwise machined into the neck of the hammer head parallel to and beneath the poll. The nail head seat is formed with a conical-taper to accommodate a range of nail types/sizes, and to eliminate sliding and prevent shifting of the nail head despite a downwardly-arcing drive. In addition, a nail-holding device is inserted upwardly into the poll of the hammer head, and this extends either a clip or magnet downward beneath the poll to support the length of the nail. The nail-holding device is flanked by two opposing lobes which provide a deeply grooved nail shaft guide for further support and protection of the nail. The length of the nail is supported by a clip or magnetic nail-holding insert that is set into a borehole running upward into the poll of the hammer. With the foregoing configuration, the nail is loaded from beneath the striking head and is lodged in the crook of the hammer's neck and poll. The nail head seat with conical-taper eliminates sliding and provides a contact surface for the nail head that is properly angled to offset the striking force resulting from a downwardly-arcing hammer. The nail-holding insert is set between lobes that form an elongate channel for further supporting the length of the nail and for protection of the carpenter. Given this configuration, the nail is substantially self-releasing after the initial nail-setting strike. The hammer head structure will start a nail with maximum stability and minimum effort.

10 Claims, 5 Drawing Sheets

NAIL-STARTING HAMMER HEAD

CROSS-REFERENCE TO RELATED APPLICATIONS

The present application is a continuation-in-part of U.S. patent application Ser. No. 09,288,129 for "HAMMER HEAD STRUCTURE", filed: Apr. 8, 1999, now abandoned.

BACKGROUND OF THE INVENTION

1. Field of the invention

The present invention relates to hammers and, more particularly, to an improved nail-starting hammer head for starting a nail in a structure with maximum stability and minimum effort.

2. Description of the Background

The use of hammers with a nail-starting capability is known in the prior art. Generally, these devices temporarily hold a nail in some sort of holding device. Both retention clips and magnets have been used for this purpose. The holding device holds the nail through a short starting stroke so that the nail strikes the wood and begins to penetrate. The nail is then freed and driven the rest of the way with full force. Despite the simplicity of the concept, there are many subtle design considerations that should be accounted for. For example, the holding device should fit a variety of nails that are standard in the field of carpentry. From 6 penny to 16 penny nails are typical, and these may be standard headed, finish headed, and even double headed. There are also special purpose nails such as roofing nails, drywall nails, and special industrial nails, etc. In addition to nail-size considerations, the holding device must be economically incorporated into the hammer head, and it must be stable, safe and easy to use. In the latter regard, the holding device must be strong and able to securely seat the foregoing variety of nails and sizes against a firm downwardly-pivoting stroke. The seating should remain stable despite off-center swings, mishits, angular impact, turning handles, etc. Perhaps most importantly, the holding device must be easy to use. An auto-releasing feature helps in this regard so that the user can release the nail from the holder without effort and continue on immediately with full-force pounding.

The prior art in this area is very crowded, and yet each known reference seems to pursue only one or two of the above-referenced design objects.

Specifically, many prior art references suggest top-loading devices. For example, U.S. Pat. No. 4,273,172 to Palomera, U.S. Pat. No. 5,988,020 to Johnson, U.S. Pat. No. 5,894,764 to Hoosier, U.S. Pat. No. 5,894,764 to Hanlon, U.S. Pat. No. 3,987,828 to Matheis, U.S. Pat. No. 4,448,230 to Reed and others all teach top loading devices in which the nail is inserted on the top of the holding device. Top loaders are inherently unstable against the downward arc of a typical hammer swing, and the nails seated therein are susceptible to ejection.

There are many bottom-loading devices that provide somewhat more stability. However, these often sacrifice the convenience of automatic nail-release. Preferably, once the nail has been set, the carpenter should be able to expediently disengage the hammer from the nail without the need for significant force, un-clipping or angling motions, etc. This way, he can proceed uninterrupted to pounding in the nail and, after repeating the task time after time, finish the job much more quickly. None of the known bottom-loading devices provide this capability. Specifically, U.S. Pat. No. 1,133,277 to Gore, U.S. Pat. No. 903,095 to Johnson, U.S. Pat. No. 937,987 to Carlson, U.S. Pat. No. 3,788,372 to Aherin, and U.S. Pat. No. 1,922,890 to Gevert all shown bottom-loading self-starting nail drivers with nail clips or the like on the bottom of the hammer head that require varying degrees of manipulation to disengage the nail from the head of the hammer after it has been set. This effort can and should be eliminated.

A singular U.S. Pat. No. 4,193,433 to Sickler shows a nail holding hatchet (FIGS. 5–9) with a crotch running along the bottom of the hammer head which guides the nail, and a flat recess in the bottom neck of the hammer head to stabilize the head of the nail. No magnet or clip insert is suggested. However, the configuration of the nail holding device itself is more stable than the foregoing patents for the following reasons:

1. The nail is loaded from beneath the striking head.
2. The head of the nail is seated within a flat recess.
3. The length of the nail is seated and supported within a crotch.

In addition to the above, the nail is more easily disengaged by shifting the hammer which, according to Mr. Sickler, can be mastered after a few practice strokes. These three qualities provide a good foundation for the improvements of the present invention which, when combined, provide an improved nail-starting hammer head for starting a nail in a structure with absolute maximum stability and minimum effort.

SUMMARY OF THE INVENTION

It is, therefore, an object of the present invention to provide a hammer head structure with integral nail-starting holder that combines all the foregoing advantages without sacrificing any, thereby improving the utility of the concept.

More specifically, it is an object to provide a hammer head structure with integral nail-starting holder that combines the following basic features:

1. Nail is loaded from beneath the striking head for maximum stability.
2. Head of the nail is seated within a specially-forged (or bored) nail head seat which provides a conical-taper to accommodate a range of nail types/sizes, and which eliminates sliding and prevents shifting despite a downwardly-arcing drive.
3. Length of the nail is supported by a clip or magnet.
4. Clip or magnet is seated between lobes that form an elongate channel for further support and protection.

According to the present invention, the above-described and other objects are accomplished by providing an improved nail-starting hammer head for starting a nail in a structure with maximum stability and minimum effort. The hammer head structure is of a type that includes a neck with integral poll portion. A nail head seat is horizontally forged, bored or otherwise machined into the neck of the hammer head parallel to and beneath the poll. The nail head seat is formed with a conical-taper to accommodate a range of nail types/sizes, and to eliminate sliding and prevent shifting of the nail head despite a downwardly-arcing drive. In addition a nail-holding device is inserted upwardly into the poll of the hammer head, and this extends either a clip or magnet downward beneath the poll to support the length of the nail. The nail-holding device is flanked by two opposing lobes which provide a deeply grooved nail shaft guide for further support and protection of the nail. With the foregoing configuration, the nail is loaded from beneath the striking head for maximum stability (the nail head is lodged in the crook of the hammer's neck and poll). Moreover, the specially-forged (or bored) nail head seat (with conical-taper) eliminates sliding and provides a contact surface for the nail head that is properly angled to offset the striking force resulting from a downwardly-arcing hammer. The length of the nail is supported by a clip or magnetic nail-holding insert that is set into a borehole running upward into the poll of the hammer. The nail-holding insert is set between lobes that form an elongate channel for further supporting the length of the nail and for protection of the carpenter. Given this configuration, the nail is substantially self-releasing after the initial nail-setting strike. Consequently, and as will be described more fully below, the foregoing features result in a hammer head structure that will start a nail with maximum stability and minimum effort.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
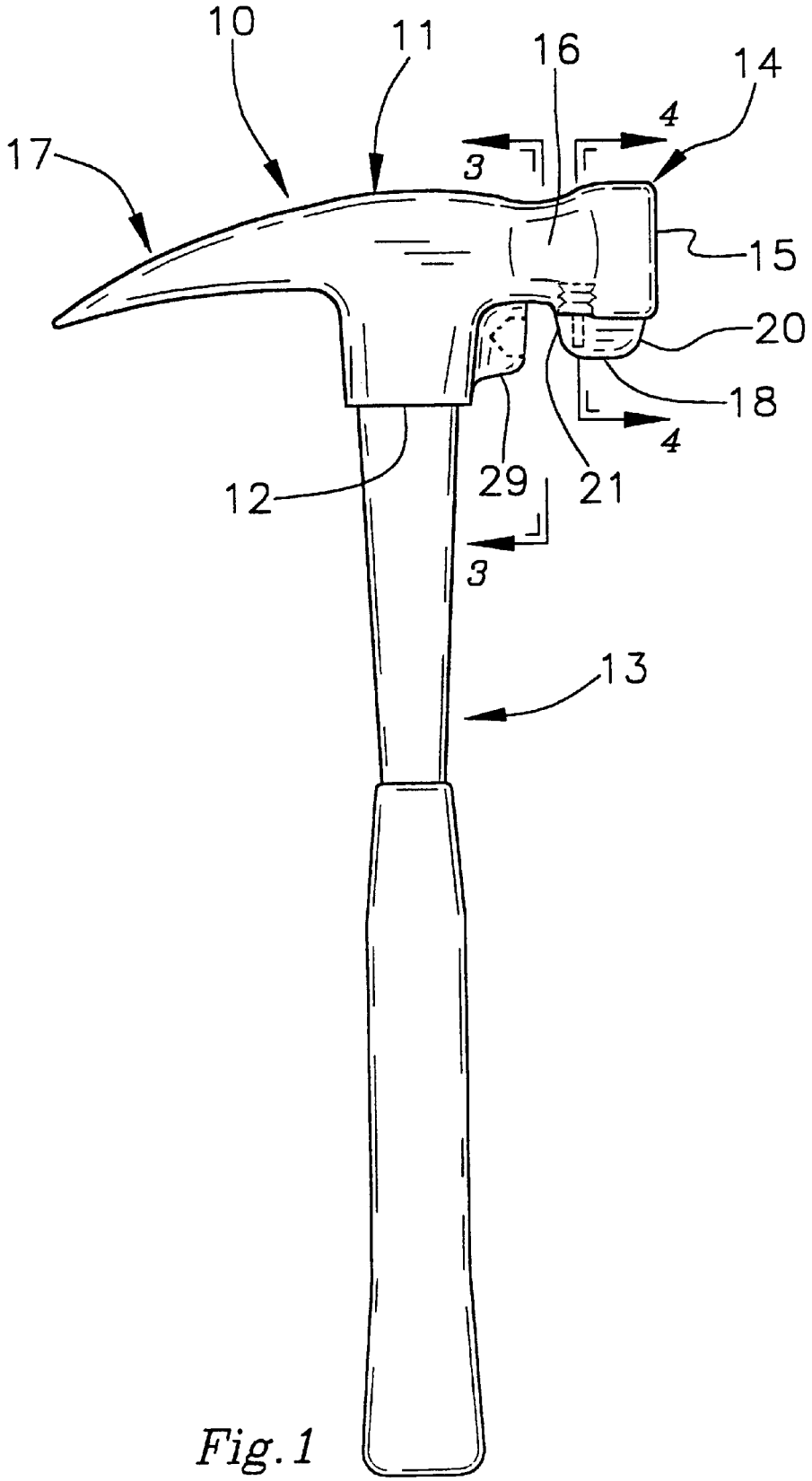
FIG. 1 is a schematic side view of a new hammer head structure according to the present invention.

FIG. 1 is a schematic side view of a new hammer head structure according to the present invention. The hammer head structure generally includes a neck portion 11 having an eye 12 designed for receiving a hammer handle 13 therein, a poll portion 14 with a striking face 15, and a rearwardly extending claw 17 portion outwardly extending rearward. The front striking face 15 of the poll portion 14 is designed for striking a nail head therewith.

In accordance with the present invention, a nail-starting holder is integrally incorporated in the hammer head structure within the crook of the neck 11 and poll portion 14. The nail-starting holder wields a nail forwardly of the poll portion 14 in order to start it. The nail-starting holder comprises a guide channel 19 formed by opposing lobes 18 that leave front and back openings 20, 21 therein. The front opening of the guide channel is positioned towards the front striking face of the poll portion 14. The back opening of the guide channel faces and is spaced apart from the neck portion 11. A clip insert 25 is inserted upwardly into the poll 14 of the hammer head, and the clip insert 25 extends two opposing prongs 26, 27 of a retaining clip down into the guide channel. The guide channel seats and guides the nail that is held therein by the clip insert 25.

Figure 2:
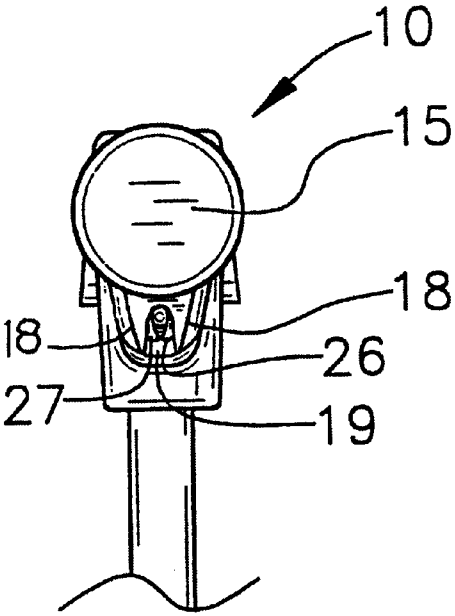
FIG. 2 is a schematic front view of the present invention.

FIG. 2 is a schematic front view of the present invention which better shows the front opening of the guide channel extended downward beneath the front striking face of the poll portion 14. The guide channel 19 has a generally inverted U-shaped transverse cross section.

Figure 3:
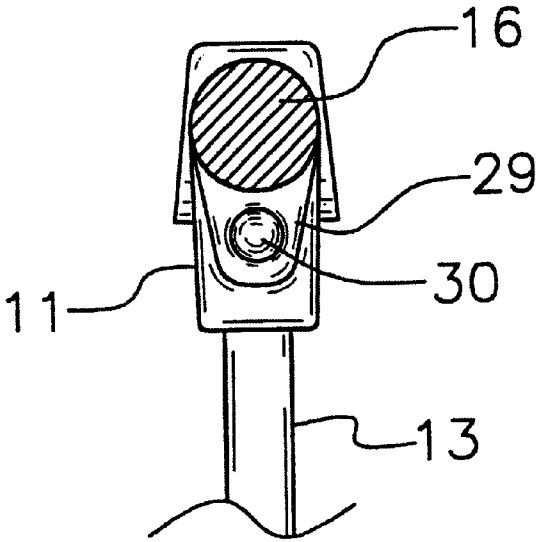
FIG. 3 is a schematic cross sectional view of the present invention taken from line 3—3 of FIG. 1.

FIG. 3 is a schematic cross sectional view of the present invention taken from line 3—3 of FIG. 1. The neck 12 of the hammer is formed with a raised portion 29 facing outward toward the striking face beneath the poll 14. The raised portion 29 is formed with a central depression that provides a nail head seat 30. As seen in FIG. 1, the nail head seat 30 is specifically formed by forging, drilling or otherwise machining a uniform cylindrical aperture leading to a tapered surface for seating the nail head. The conically-tapered walls converge at an angle of between 90–120 degrees (e.g., the angular taper is preferably between 45–60 degrees from horizontal). This particular configuration serves two purposes. First of all, the nail head seat 30 can be dimensioned to seat a wide variety of nails, including 6 penny to 16 penny nails having standard heads, finish heads, or even double heads. By uniformly resizing the nail head seat 30, it can be made to accommodate roofing nails, drywall nails, and special industrial nails as well. No matter which type of nail, the rim of the nail head is automatically centralized against the tapered surface. This prevents the bead from shifting around under load. Moreover, the stated angle of the taper directly reinforces the head against any torsional kickback resulting from a nail-setting strike. More specifically, a typical strike comprises a downward pivoting at the wrist culminating at impact. The downward angle results in an upward force to the tip of the nail, which in turn leverages the nail about the holding device, thereby pivoting the head of the nail downward and away from the neck of the hammer. However, the angle of the tapered nail head seat is substantially orthogonal to the plane of the nail head and thereby directly counteracts the torsion. The nail head is locked in position and cannot move or slide at all.

Figure 4:
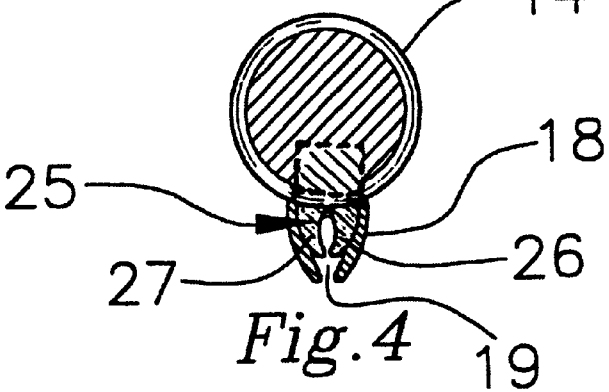
FIG. 4 is a schematic cross sectional view of the present invention taken from line 4—4 of FIG. 1.

FIG. 4 is a schematic cross sectional view of the present invention taken from line 4—4 of FIG. 1. In the illustrated embodiment, the prongs 26, 27 of the holding device comprise a spaced apart pair of opposing resilient arms that may be formed of plastic, metal and/or rubber. Prongs 26 and 27 conform to the cylinder of a standard nail, and they are anchored in the base 39 of clip insert 25 which is inserted upwardly into the poll 14 of the hammer head. The prongs 26, 27 are free to flex outward until constrained by the opposing lobes 18 of the guide channel. The spacing of the prongs 26, 27 of the retaining clip are designed for straddling the elongate portion of a nail within the guide channel so that the arms of the retaining clip resiliently releasably hold the elongate portion of the nail in the guide channel.

Figure 5:
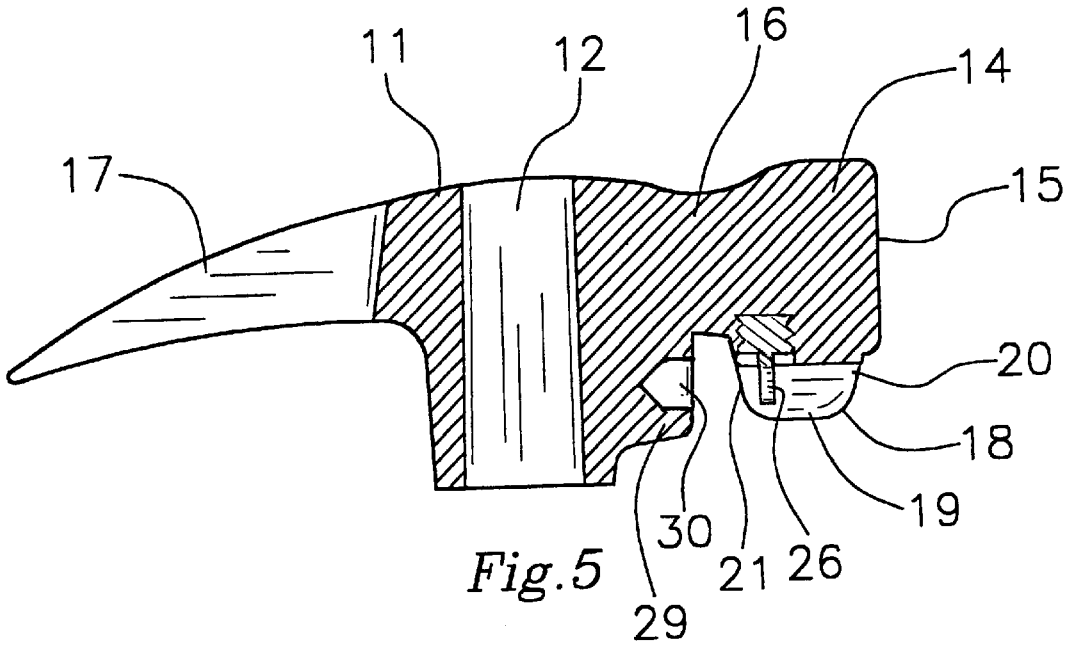
FIG. 5 is a schematic cross sectional view of the present invention taken in a plane substantially perpendicular to the planes of the cross sections depicted in FIGS. 3 and 4.

FIG. 5 is a schematic cross sectional view of the present invention taken in a plane substantially perpendicular to the planes of the cross sections depicted in FIGS. 3 and 4.

Figure 6:
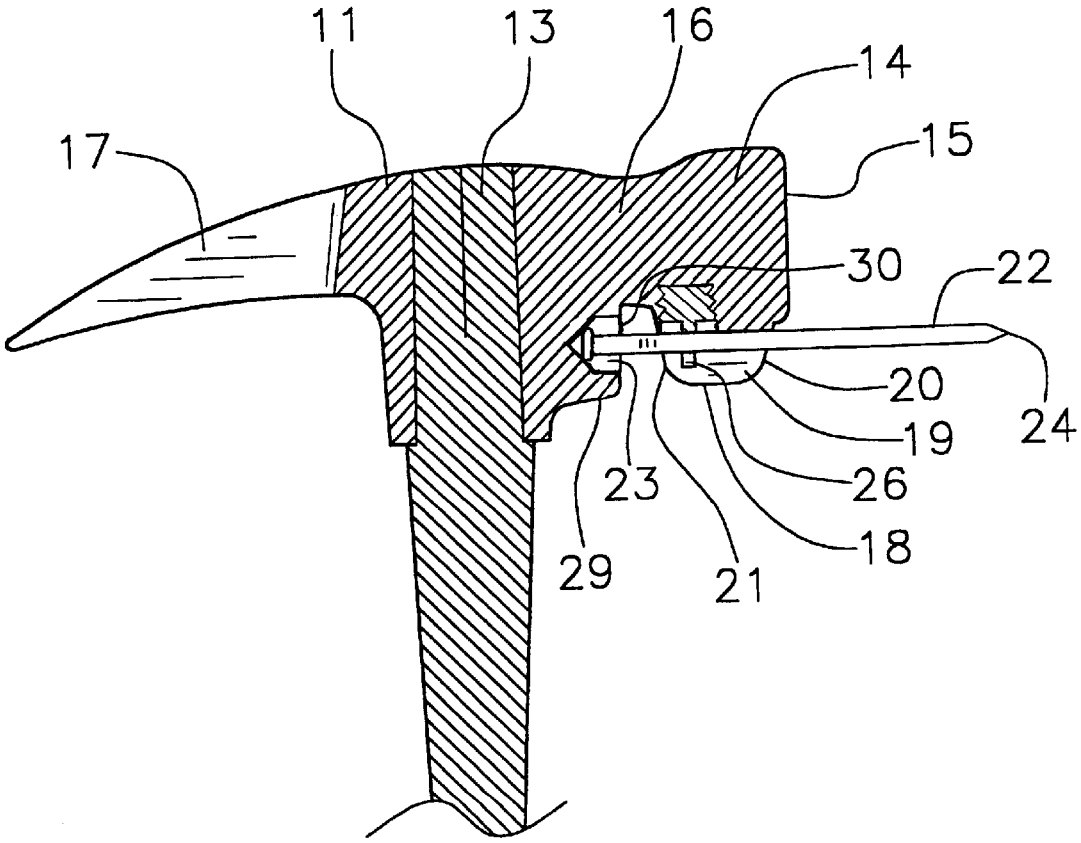
FIG. 6 is a schematic cross sectional view of the present invention as depicted in FIG. 5 in use holding a nail.

FIG. 6 is a schematic cross sectional view of the present invention as depicted in FIG. 5 while holding a nail 22. In use, as best illustrated in FIGS. 5–6, the guide channel is designed for extending an elongate portion of nail 22 there through such that a head 23 of the nail is outwardly extended from the back opening of the guide channel and a pointed tip 24 of the nail is outwardly extended from the front opening of the guide channel. The triangle of contact points formed by the seated nail head, the clipped mid-section of the nail seated in the groove 19, and the tip of the nail at impact exactly counteracts the natural arc through which the hammer travels. The support afforded by the deep groove 19 defined by opposing lobes 18, and its location underneath the hammer bead, combine to give more stability than any top loading devices as in the prior art. Moreover, the lobes 18 protect against sideways deflection of the nail during impact, and they improve the toenail stability of the hammer through off-center swings, mishits, angular impact, turning handles, etc. The lower mounting of the holding device is paramount to the action and reaction and effect of the nails interaction with the hammer's momentum when the nail is being driven into the wood. Further, the angular taper of the nail head seat seats the nail more tightly and transfers momentum into the nail head more efficiently along the length of the nail. None of the prior art references teach or suggest this wedging action.

Figure 7:
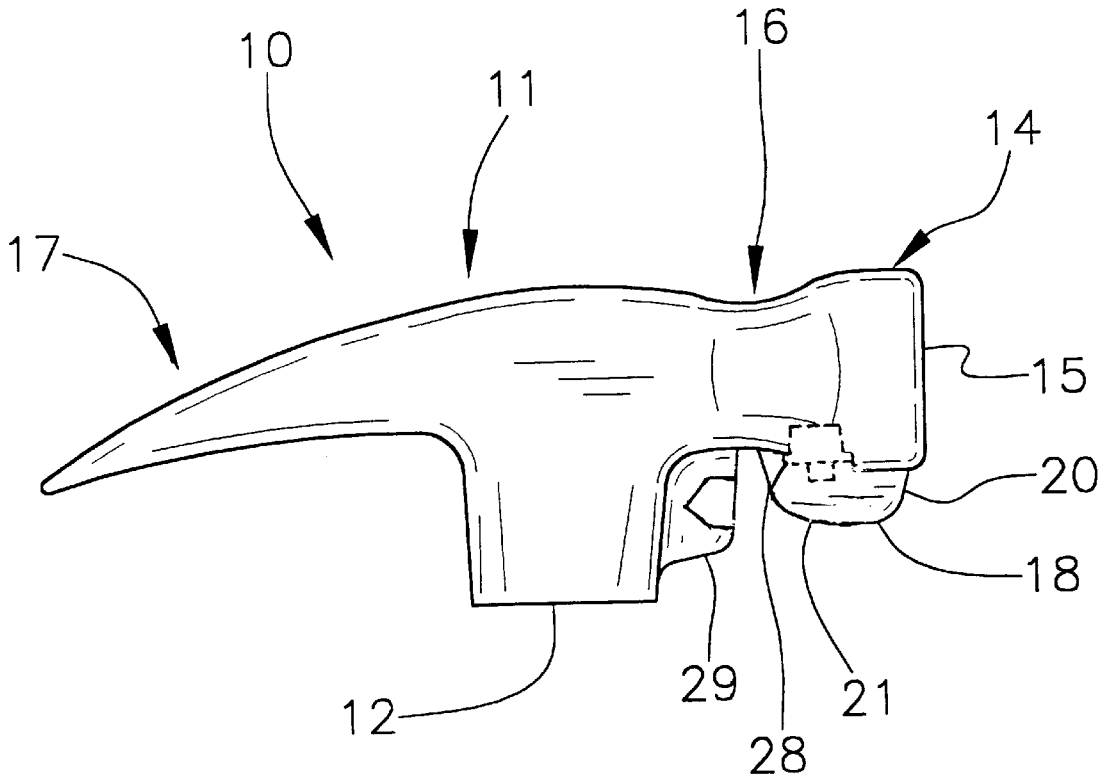
FIG. 7 is a schematic side view of an optional embodiment of the present invention having a magnet for holding the nail in the guide channel.

FIG. 7 is a schematic side view of an optional embodiment of the present invention having a magnetic insert 28 for holding the nail in the guide channel. Like the prongs 26, 27 of the clip, the magnetic insert 28 only has to hold the nail in place until the wedging action takes its place. Magnetic insert 28 is likewise adapted for insertion upwardly into the poll of the hammer and may be anchored therein by a compression pin 52 as shown or by screw threads as with the clip insert 25 of FIGS. 1–6.

Figure 8:
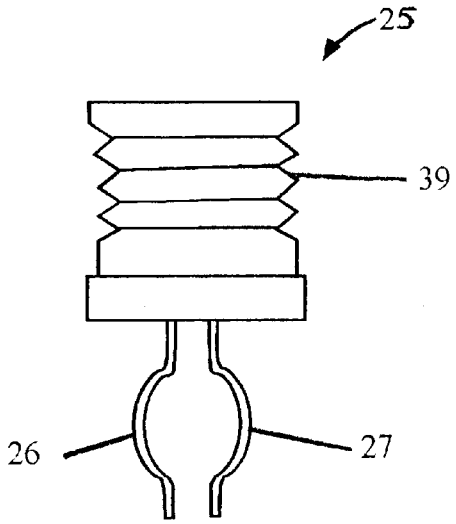
FIG. 8 is a close-up perspective front view of the clip insert 25 of FIGS. 1–6.
Figure 9:
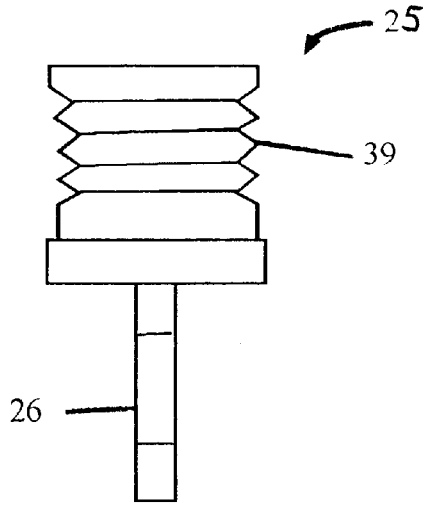
FIG. 9 is a close-up perspective side view of the clip insert 25 of FIG. 8.

FIG. 8 is a close-up perspective front view of the clip insert 25 of FIGS. 1–6. FIG. 9 is a close-up perspective side view of the clip insert 25 of FIG. 8. Clip insert 25 includes a threaded cylindrical base portion 39 which is adapted for screw-insertion upwardly into the poll of the hammer. Prongs 26 and 27 are curved to conform to the cylinder of a standard nail, and they are embedded in the base 39 of holding device 25. The prongs 26, 27 are resilient and flex outward. The tips of prongs 26, 27 may be dipped in rubber to improve the coefficient of friction. In addition, a hex key socket or screw driver slot may be provided (off-set slightly from the prongs) to facilitate screwing of the clip insert 25 into the poll.

Figure 10:
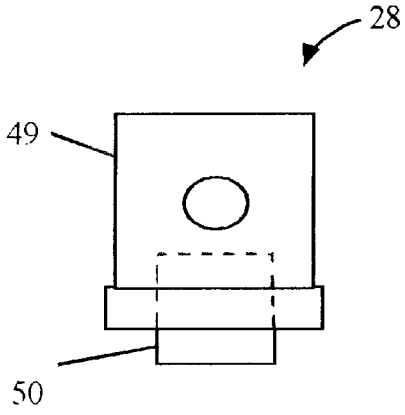
FIG. 10 is a close-up perspective side view of the magnet insert 28 of FIG. 7.
Figure 11:
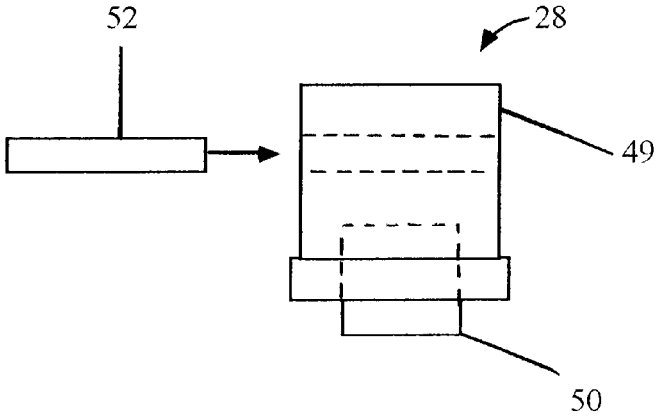
FIG. 11 is a close-up perspective front view of the magnet insert 28 of FIG. 10.

FIG. 10 is a close-up perspective side view, and FIG. 11 is a close-up perspective front view of the magnet insert 28 of FIG. 10. This embodiment includes a smooth cylindrical base 49 which is held in the head of the hammer by a retaining pin 52 inserted side-to-side there through. The base 49 is an annular steel or plastic ferrule with an opening to seat the magnetic bit 50. Note that the annular non-magnetic base 49 surrounds the magnet 50 and prevents magnetization of the hammer head, which otherwise would attract metal particles such as iron filings. In use, the magnet 50 is designed for magnetically coupling a portion of the elongate portion of the nail in the guide channel.

It should be apparent that the magnetic insert 28 and clip insert 25 may be alternately anchored in the poll of the hammer with either screw threads or with the compression pin 52. Given either choice of screw threads or pin 52, the magnetic insert 28 and clip insert 25 are easily replaceable and/or fully interchangeable. Alternatively, as a matter of design choice, the magnetic insert 28 and clip insert 25 may be permanently attached.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. In a hammer head comprising an integral neck, claw and striking poll, an integral nail-starting feature, comprising:

a nail head seat formed in the neck of the hammer head and open outward beneath said poll, said nail head seat being formed with conically-tapered walls to accommodate a range of nail types and sizes and to reduce shifting of a nail head;

a nail-holding device secured to the poll of the hammer head and extending a nail-engaging member downward beneath the poll for supporting the length of said nail;

a pair of opposing lobes flanking said nail-holding device and providing an elongate channel for support and protection of said nail;

whereby said nail may be loaded from beneath the poll and lodged in a crook of the hammer neck supported by said nail-holding device between the pair of opposing lobes, thereby providing a nail-starting feature that is substantially self-releasing after an initial nail-setting strike.

2. The integral nail-starting feature according to claim 1, wherein said nail-holding device further comprises a generally cylindrical body anchored in said poll and extending opposing prongs of a nail-engaging clip downward beneath the poll for supporting the length of said nail.

3. The integral nail-starting feature according to claim 2, wherein said annular body is anchored in a hole in said poll by screw threads.

4. The integral nail-starting feature according to claim 2, wherein said annular body is anchored in a hole in said poll by a compression pin.

5. The integral nail-starting feature according to claim 1, wherein said nail-holding device further comprises a generally cylindrical body anchored in a hole in said poll and extending a magnet downward beneath the poll for supporting the length of said nail.

6. The integral nail-starting feature according to claim 5, wherein said annular body is anchored in the hole in said poll by screw threads.

7. The integral nail-starting feature according to claim 5, wherein said annular body is anchored in the hole in said poll by a compression pin.

8. The integral nail-starting feature according to claim 5, wherein said annular body further comprises a non-magnetic shield in which said magnet is seated for preventing magnetization of the hammer head by the magnet.

9. The integral nail-starting feature according to claim 1, wherein said conically-tapered walls converge at an angle of between 90–120 degrees to reduce shifting of the nail head.

10. The integral nail-starting feature according to claim 1, wherein an axis of the nail head seat is aligned with the elongate channel beneath the poll, and said nail-holding device is positioned midway along said elongate channel for supporting the length of said nail.

* * * * *